US007320651B2

(12) United States Patent
Sajima

(10) Patent No.: US 7,320,651 B2
(45) Date of Patent: Jan. 22, 2008

(54) GOLF BALL

(75) Inventor: Takahiro Sajima, Kobe (JP)

(73) Assignee: SRI Soprts Limited, Kobe (JP)

( * ) Notice: Subject to any disclaimer, the term of this patent is extended or adjusted under 35 U.S.C. 154(b) by 0 days.

(21) Appl. No.: 11/647,411

(22) Filed: Dec. 29, 2006

(65) Prior Publication Data

US 2007/0173354 A1 Jul. 26, 2007

(30) Foreign Application Priority Data

Jan. 24, 2006 (JP) ..... 2006-014517

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,744,564 A * 5/1988 Yamada ..... 473/379
5,072,945 A * 12/1991 Oka et al. ..... 473/384
5,090,705 A * 2/1992 Oka et al. ..... 473/384
5,156,404 A * 10/1992 Oka et al. ..... 473/382
6,066,055 A 5/2000 Nishino

* cited by examiner

*Primary Examiner*—Raeann Trimiew
(74) *Attorney, Agent, or Firm*—Birch, Stewart, Kolasch & Birch, LLLP

(57) ABSTRACT

Golf ball 2 has three or more different kinds of dimples 8. The total number of the dimples 8 is 300 or more. A ratio Pn of the number of the dimples 8 with a diameter of equal to or greater than 3.40 mm to the total number is equal to or greater than 90%. The golf ball 2 meet the following formulae (I) and (II).

$$NL-NH \geqq 0 \quad \text{(I)}$$

$$NL > NHm \geqq NHp \quad \text{(II)}$$

NL represents the number of kinds of the dimples being located in a low latitude region ZL and having a diameter of equal to or greater than 3.40 mm, NH represents the number of kinds of the dimples being located in a high latitude region ZH and having a diameter of equal to or greater than 3.40 mm, NHm represents the number of kinds of the dimples being located in a middle latitude region ZHm and having a diameter of equal to or greater than 3.40 mm and NHp represents the number of kinds of the dimples being located in a polar region ZHp and having a diameter of equal to or greater than 3.40 mm.

4 Claims, 11 Drawing Sheets

C
D
B
B
C
C
B
B
B
C
C
B
D
C
A
B
C
A
B
C
A
B

GOLF BALL

This application claims priority on Patent Application No. 2006-14517 filed in JAPAN on Jan. 24, 2006, the entire contents of which are hereby incorporated by reference.

BACKGROUND OF THE INVENTION

1. Field of the Invention

The present invention relates to golf balls. More particularly, the present invention relates to improvement of dimple of golf balls.

2. Description of the Related Art

Golf balls have numerous dimples on the surface thereof. The dimples cause turbulent flow separation through disrupting the air flow around the golf ball during the flight. By causing the turbulent flow separation, a separating point of air from the golf ball shifts backwards leading to the reduction of drag. The turbulent flow separation promotes the differentia between upper separating point and lower separating point of the golf ball, which results from the backspin, thereby enhancing a lift force that acts upon the golf ball. The reduction of drag and the enhancement of lift force are referred to as "dimple effect". Excellent dimples disturb the air flow more efficiently. The excellent dimples achieve great flight distance.

For golf balls, not only flight distance but also aerodynamic symmetry is important. The flight distance of the golf balls with excellent aerodynamic symmetry does not depend on the rotation axis of the backspin. Golf players easily let this golf ball drop on a targeted position. Also, in view of conformity to the rule defined by United States Golf Association, aerodynamic symmetry is important.

A mold for a golf ball consists of an upper mold half and a lower mold half. Each of the upper mold half and the lower mold half has a hemispherical cavity face. When the upper and the lower mold are mated, a spherical cavity is formed. This mold has a parting line between the upper and the lower mold half. The parting line is a great circle. On a surface of a golf ball, a portion which corresponds to the parting line is referred as an equator (or a seam). The equator is a great circle. The vicinity of the equator is a particular region. U.S. Pat. No. 6,066,055 (JP-A No. 2000-93556) discloses a proposal to remove the particularity in the equator vicinity region.

In the vicinity of the equator, many of dimples tend to be arranged orderly. When golf balls have dimples arranged orderly, a great dimple effect can not be achieved. With this golf ball, a sufficient flight distance can not be achieved.

When a portion that has the fastest circumferential velocity of the backspin is on the equator, a dimple effect achieved by the golf ball with dimples arranged orderly is particularly small. On the other hand, when the portion that has the fastest circumferential velocity of the backspin is not on the equator, a measure of dimple effect can be achieved. In this golf ball, a flight distance depends on the rotation axis of the backspin. This golf ball is inferior in aerodynamic symmetry.

An object of the present invention is to provide a golf ball with which a great flight distance is achieved and that is excellent in aerodynamic symmetry.

SUMMARY OF THE INVENTION

A golf ball according to the present invention has three or more different kinds of dimples, each having a different diameter, on the surface thereof. Total number of the dimples is 300 or greater. A ratio Pn of the number of the dimples with a diameter of equal to or greater than 3.40 mm to the total number of the dimples is equal to or greater than 90%. NL and NH, which represent the number of kinds of the dimples, meet the following formula (I).

$$NL-NH \geqq 0 \quad \text{(I)}$$

In the above formula (I), NL represents the number of kinds of the dimples being located in a low latitude region whose latitude is 0 degree or greater and less than 30 degrees, and having a diameter of equal to or greater than 3.40 mm. NH represents the number of kinds of the dimples being located in a high latitude region whose latitude is 30 degrees or greater and 90 degrees or less, and having a diameter of equal to or greater than 3.40 mm. Further, NL, NHm and NHp, which represent the number of kinds of the dimples, meet the following formula (II).

$$NL > NHm \geqq NHp \quad \text{(II)}$$

In the above formula (II), NL represents the number of kinds of the dimples being located in the low latitude region whose latitude is 0 degree or greater and less than 30 degrees, and having a diameter of equal to or greater than 3.40 mm. NHm represents the number of kinds of the dimples being located in a middle region whose latitude is 30 degrees or greater and less than 60 degrees, and having a diameter of equal to or greater than 3.40 mm. NHp represents the number of kinds of the dimples being located in a polar region whose latitude is 60 degrees or greater and 90 degrees or less, and having a diameter of equal to or greater than 3.40 mm.

In this golf ball, the great number of kinds of the dimples being located in the low latitude region (i.e. the vicinity of the equator) promotes the dimple effect in this low latitude region. With this golf ball, a great flight distance is achieved. This golf ball is excellent in aerodynamic symmetry.

Preferably, NL, NHm and NHp, which represent the number of kinds of the dimples, meet the following formula (III).

$$NL > NHm > NHp \quad \text{(III)}$$

Preferably, N1 to N9, which represent the number of kinds of the dimples, meet the following formula (IV).

$$N1 \geqq N2 \geqq N3 > N4 \geqq N5 \geqq N6 \geqq N7 \geqq N8 \geqq N9 \quad \text{(IV)}$$

In the above formula (IV), N1 represents the number of kinds of the dimples being located in a first region whose latitude is 0 degree or greater and less than 10 degrees, and having a diameter of equal to or greater than 3.40 mm. N2 represents the number of kinds of the dimples being located in a second region whose latitude is 10 degrees or greater and less than 20 degrees, and having a diameter of equal to or greater than 3.40 mm. N3 represents the number of kinds of the dimples being located in a third region whose latitude is 20 degrees or greater and less than 30 degrees, and having a diameter of equal to or greater than 3.40 mm. N4 represents the number of kinds of the dimples being located in a fourth region whose latitude is 30 degrees or greater and less than 40 degrees, and having a diameter of equal to or greater than 3.40 mm. N5 represents the number of kinds of the dimples being located in a fifth region whose latitude is 40 degrees or greater and less than 50 degrees, and having a diameter of equal to or greater than 3.40 mm. N6 represents the number of kinds of the dimples being located in a sixth region whose latitude is 50 degrees or greater and less than 60 degrees, and having a diameter of equal to or greater than 3.40 mm. N7 represents the number of kinds of the dimples being located in a seventh region whose latitude is 60 degrees or greater and less than 70 degrees, and having a diameter of equal to or greater than 3.40 mm. N8 represents the number of kinds of the dimples being located in an eighth region whose latitude is 70 degrees or greater and less than 80 degrees, and having a diameter of equal to or greater than 3.40 mm. N9 represents the number of kinds of the dimples being located in a ninth region whose latitude is 80 degrees or greater and 90 degrees or less, and having a diameter of equal to or greater than 3.40 mm.

DESCRIPTION OF THE PREFERRED EMBODIMENTS

The present invention is hereinafter described in detail with appropriate references to the accompanying drawing according to the preferred embodiments.

Figure 1:
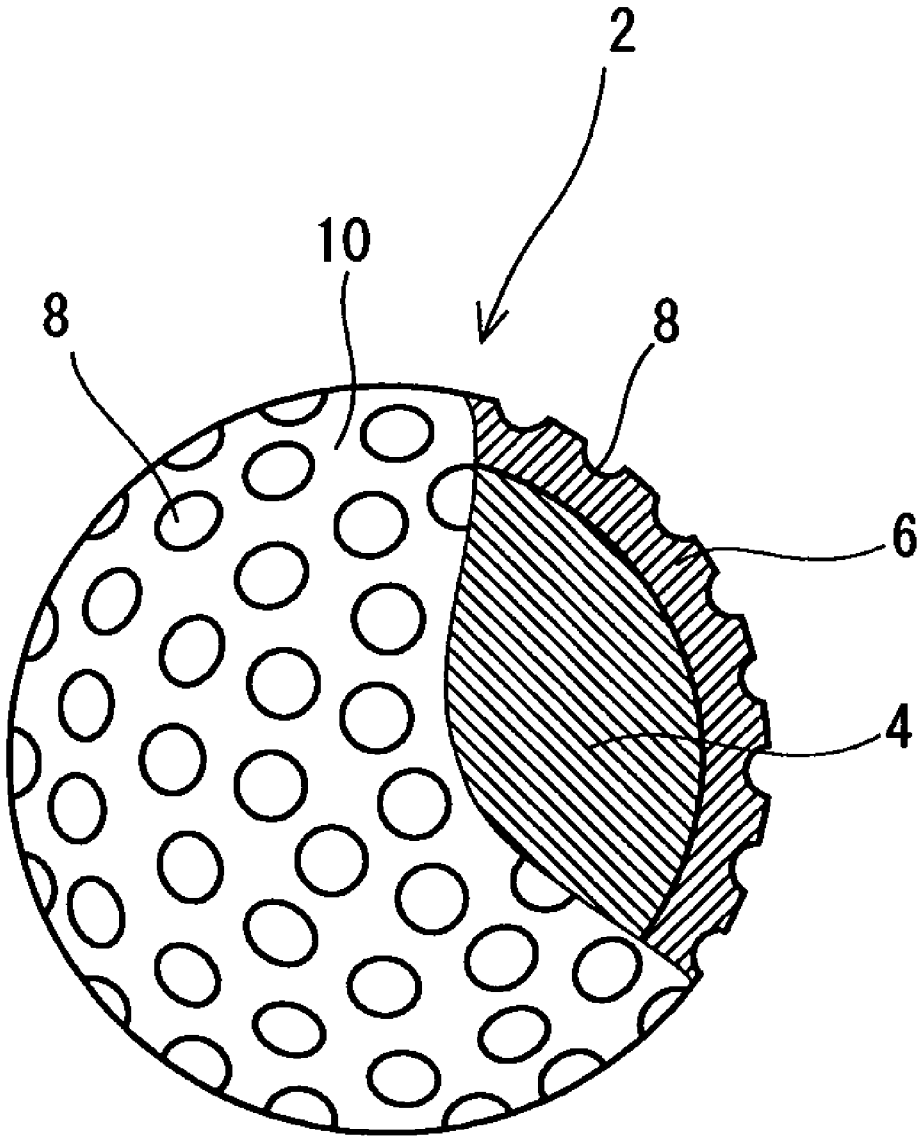
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. A part of the surface of the golf ball 2 except for the dimples 8 is a land 10. This golf ball 2 has a paint layer and a mark layer to the external side of the cover 6, although these layers are not shown in the Figure. A mid layer may be provided between the core 4 and the cover 6.

This golf ball 2 has a diameter of from 40 mm to 45 mm. From the standpoint of conformity to the rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to the rule defined by USGA, the weight is more preferably equal to or less than 45.93 g.

The core 4 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 4, a co-crosslinking agent is preferably used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, sulfur, an anti-aging agent, a coloring agent, a plasticizer, a dispersant and the like may be blended at an appropriate amount to the rubber composition as needed. Crosslinked rubber powder or synthetic resin powder may be blended to the rubber composition.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core may be composed of two or more layers.

A preferable polymer for the cover 6 is an ionomer resin. Examples of preferred ionomer resin include binary copolymers formed with α-olefin and an α,β-unsaturated carboxylic acid having 3 to 8 carbon atoms. Examples of the other ionomer resin include ternary copolymers formed with a-olefin, an α,β-unsaturated carboxylic acid having 3 to 8 carbon atoms and an α,β-unsaturated carboxylate ester having 2 to 22 carbon atoms. In the binary copolymer and ternary copolymer, preferable α-olefin may be ethylene and propylene, while preferable α,β-unsaturated carboxylic acid may be acrylic acid and methacrylic acid. In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion.

In stead of the ionomer resin, or together with the ionomer resin, other polymer may also be used. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

To the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be blended with powder of a highly dense metal such as tungsten, molybdenum or the like for the purpose of adjusting the specific gravity.

Thickness of the cover 6 is equal to or greater than 0.3 mm, and particularly equal to or greater than 0.5 mm. Thickness of the cover 6 is equal to or less than 2.5 mm, and particularly equal to or less than 2.2 mm. Specific gravity of the cover 6 is equal to or greater than 0.90, and particularly equal to or greater than 0.95. Specific gravity of the cover 6 is equal to or less than 1.10, and particularly equal to or less than 1.05. The cover may be composed of two or more layers.

Figure 2:
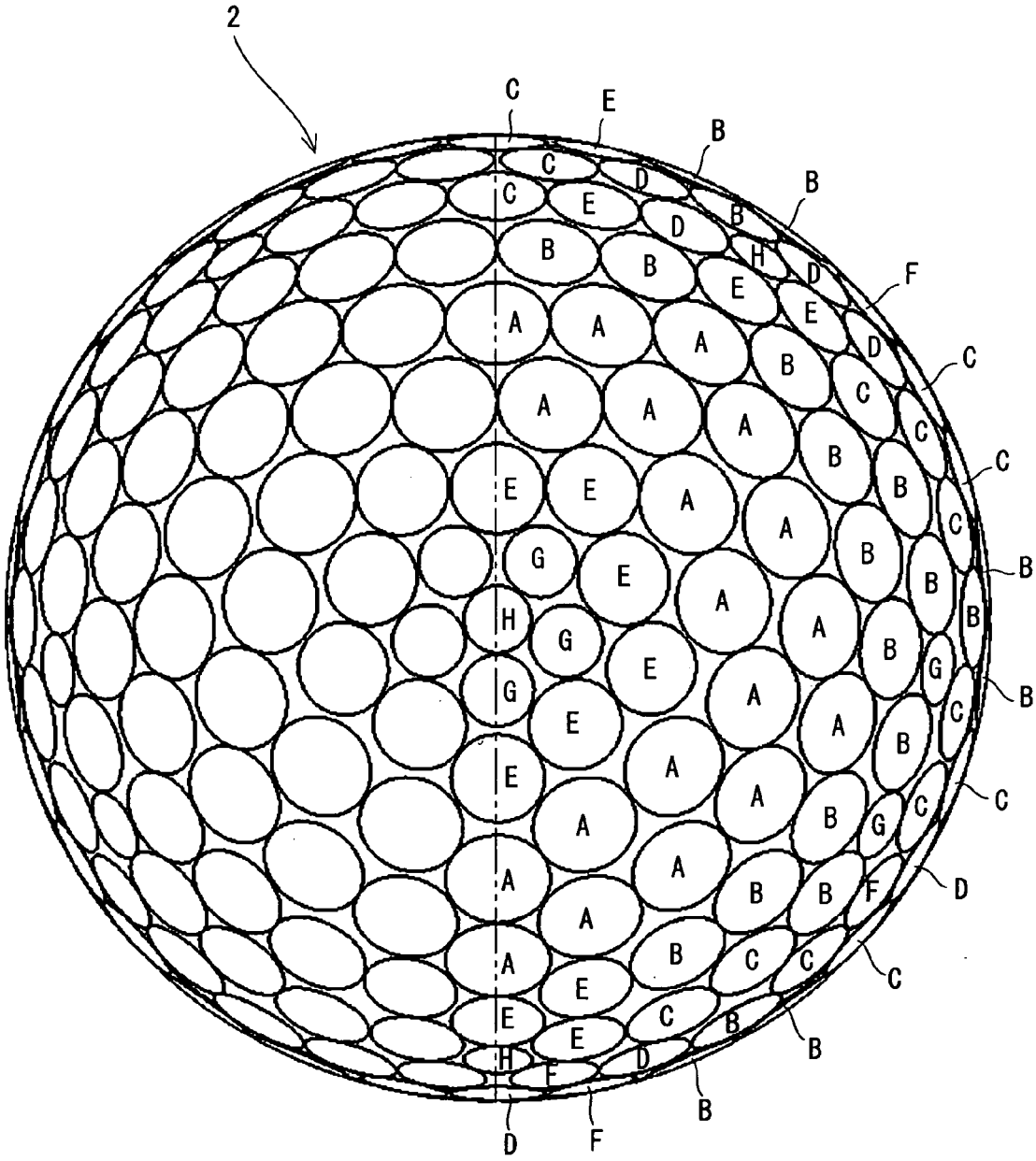
FIG. 2 is an enlarged plan view illustrating the golf ball shown in FIG. 1.

FIG. 2 is an enlarged plan view illustrating the golf ball 2 shown in FIG. 1. In FIG. 2, kinds of dimples 8 are depicted with symbols A to H in one unit, provided when the surface of the golf ball 2 is comparted into 4 units. This golf ball 2 has dimples A having a diameter of 4.60 mm, dimples B having a diameter of 4.45 mm, dimples C having a diameter of 4.30 mm, dimples D having a diameter of 4.20 mm, dimples E having a diameter of 4.10 mm, dimples F having a diameter of 3.90 mm, dimples G having a diameter of 3.20 mm, and dimples H having a diameter of 3.00 mm. The number of the dimples A is 70; the number of the dimples B is 88; the number of the dimples C is 56; the number of the dimples D is 26; the number of the dimples E is 42; the number of the dimples F is 20; the number of the dimples G is 18; and the number of the dimples H is 8. Total number of the dimples 8 is 328.

Figure 3:
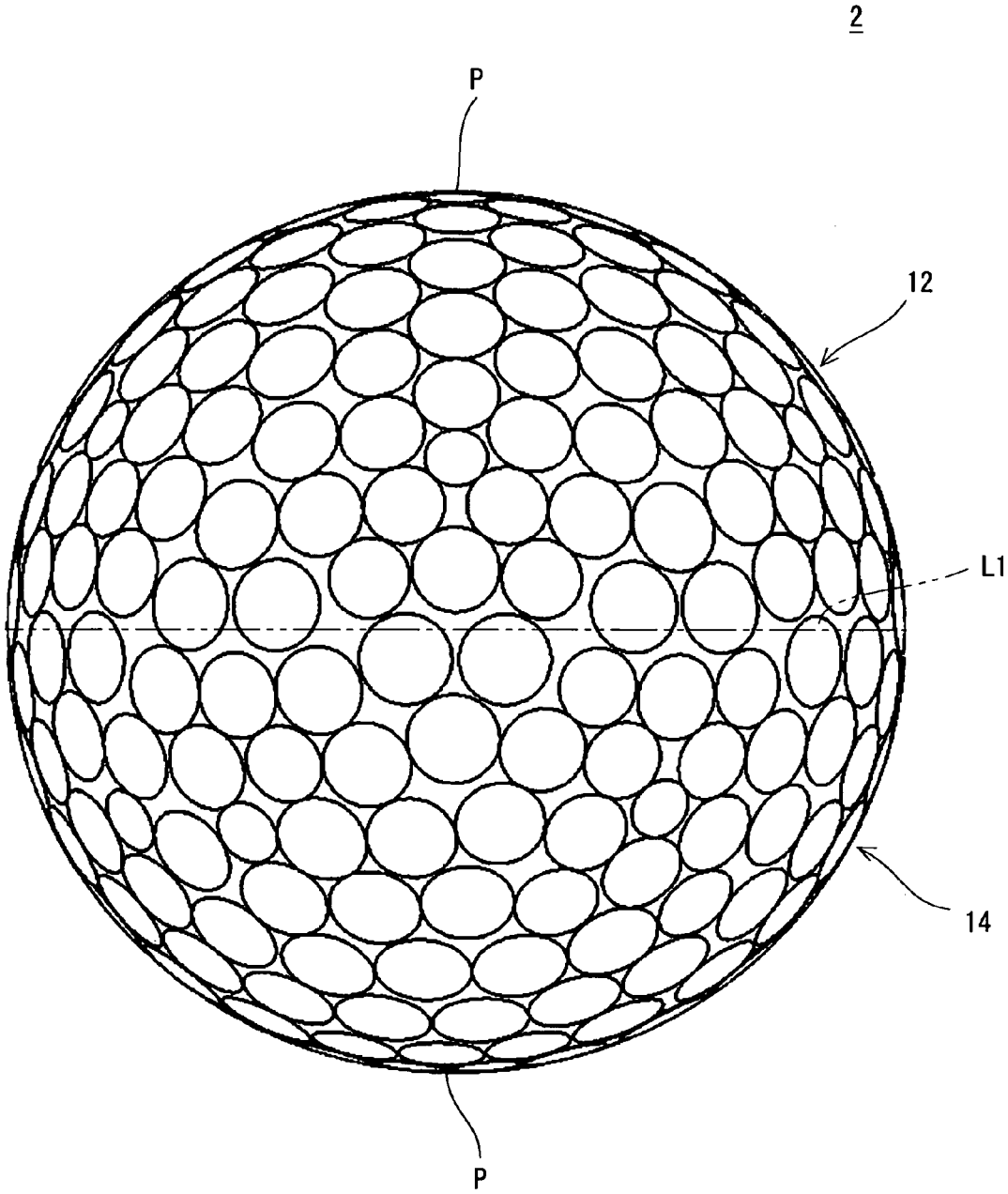
FIG. 3 is a front view illustrating the golf ball shown in FIG. 2.

FIG. 3 is a front view illustrating the golf ball 2 shown in FIG. 2. In FIG. 3, a first latitude line L1 is depicted. The first latitude line L1 has latitude of 0 degree. The first latitude line L1 is also the equator line. As is clear from FIG. 3, the first latitude line L1 intersects the dimples 8. This golf ball 2 is obtained by a mold with a parting line between an upper mold half and a lower mold half being zigzag. Intersection of the first latitude line L1 and the dimples enhances the dimple effect in the vicinity of the equator. The first latitude line L1 may not intersect the dimples 8. The surface of the golf ball 2 is comparted into a northern hemisphere 12 and a southern hemisphere 14 by the latitude line L1 as a boundary. In FIG. 3, a symbol P indicates poles. A direction from one pole P to another pole P is an opening and closing direction of the mold.

Figure 4:
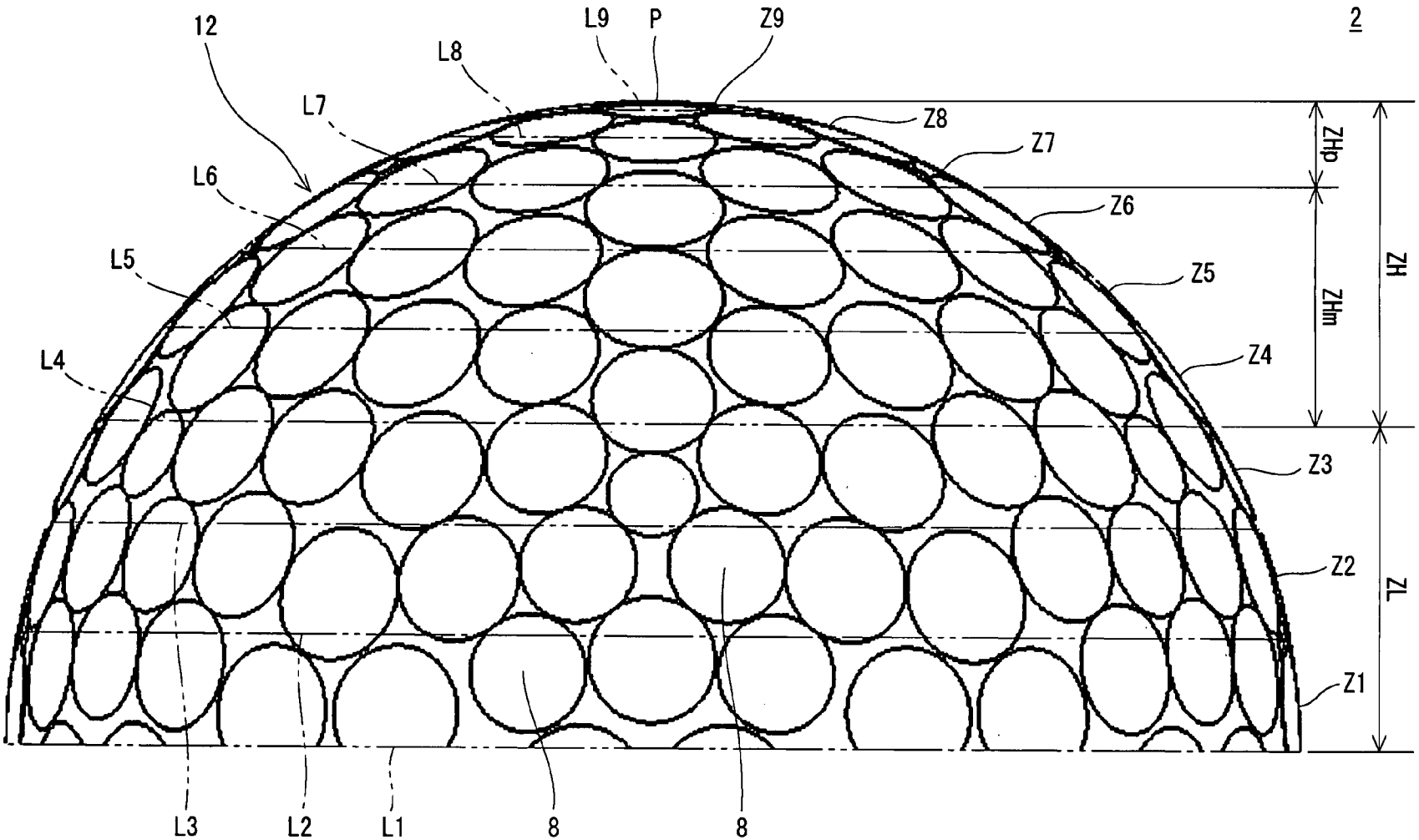
FIG. 4 is an enlarged view illustrating a part of a golf ball shown in FIG. 3.

FIG. 4 is an enlarged view illustrating a part of a golf ball 2 shown in FIG. 3. In FIG. 4, the northern hemisphere 12 is depicted. In FIG. 4, the first latitude line L1, a second latitude line L2, a third latitude line L3, a fourth latitude line L4, a fifth latitude line L5, a sixth latitude line L6, a seventh latitude line L7, a eighth latitude line L8 and a ninth latitude line L9 are depicted. The first latitude line L1 has latitude of 0 degree, the second latitude line L2 has latitude of 10 degrees, the third latitude line L3 has latitude of 20 degrees, the fourth latitude line L4 has latitude of 30 degrees, the fifth latitude line L5 has latitude of 40 degrees, the sixth latitude line L6 has latitude of 50 degrees, the seventh latitude line L7 has latitude of 60 degrees, the eighth latitude line L8 has latitude of 70 degrees and the ninth latitude line L9 has latitude of 80 degrees.

A region between the first latitude line L1 and the second latitude line L2 is a first region Z1. The first region Z1 does not include a portion on the second latitude line L2. The latitude of the first region Z1 is 0 degree or greater and less than 10 degrees. A region between the second latitude line L2 and the third latitude line L3 is a second region Z2. The second region Z2 does not include a portion on the third latitude line L3. The latitude of the second region Z2 is 10 degrees or greater and less than 20 degrees. A region between the third latitude line L3 and the fourth latitude line L4 is a third region Z3. The third region Z3 does not include a portion on the fourth latitude line L4. The latitude of the third region Z3 is 20 degrees or greater and less than 30 degrees. A region between the fourth latitude line L4 and the fifth latitude line L5 is a fourth region Z4. The fourth region Z4 does not include a portion on the fifth latitude line L5. The latitude of the fourth region Z4 is 30 degrees or greater and less than 40 degrees. A region between the fifth latitude line L5 and the sixth latitude line L6 is a fifth region Z5. The fifth region Z5 does not include a portion on the sixth latitude line L6. The latitude of the fifth region Z5 is 40 degrees or greater and less than 50 degrees. A region between the sixth latitude line L6 and the seventh latitude line L7 is a sixth region Z6. The sixth region Z6 does not include a portion on the seventh latitude line L7. The latitude of the sixth region Z6 is 50 degrees or greater and less than 60 degrees. A region between the seventh latitude line L7 and the eighth latitude line L8 is a seventh region Z7. The seventh region Z7 does not include a portion on the eighth latitude line L8. The latitude of the seventh region Z7 is 60 degrees or greater and less than 70 degrees. A region between the eighth latitude line L8 and the ninth latitude line L9 is an eighth region Z8. The eighth region Z8 does not include a portion on the ninth latitude line L9. The latitude of the eighth region Z8 is 70 degrees or greater and less than 80 degrees. A region enclosed by the ninth latitude line L9 is a ninth region Z9. The latitude of the ninth region Z9 is 80 degrees or greater and 90 degrees or less. The southern hemisphere 14 has the first to the ninth regions in the same manner as the northern hemisphere 12, which is not shown.

The northern hemisphere 12 is comparted into a low latitude region ZL and a high latitude region ZH. A compartment line between the low latitude region ZL and the high latitude region ZH is the fourth latitude line L4. The low latitude region ZL includes the first region Z1, the second region Z2 and the third region Z3. The latitude of the low latitude region ZL is 0 degree or greater and less than 30 degrees. The high latitude region ZH includes the fourth region Z4, the fifth region Z5, the sixth region Z6, the seventh region Z7, the eighth region Z8 and the ninth region Z9. The latitude of the high latitude region ZH is 30 degrees or greater and 90 degrees or less. On a phantom sphere, the surface area of the low latitude region ZL is equal to that of the high latitude region ZH. The southern hemisphere 14 also has the low latitude region ZL and the high latitude region ZH in the same manner as the northern hemisphere 12, which is not shown.

The high latitude region ZH is comparted into a middle region ZHm and a polar region ZHp. A compartment line between the middle region ZHm and the polar region ZHp is the seventh latitude line L7. The middle region ZHm includes the fourth region Z4, the fifth region Z5 and the sixth region Z6. The latitude of the middle region ZHm is 30 degrees or greater and less than 60 degrees. The polar region ZHp includes the seventh region Z7, the eighth region Z8 and the ninth region Z9. The latitude of the polar region ZHp is 60 degrees or greater and 90 degrees or less. The southern hemisphere 14 also has the middle region ZHm and the polar region ZHp in the same manner as the northern hemisphere 12, which is not shown.

Figure 5:
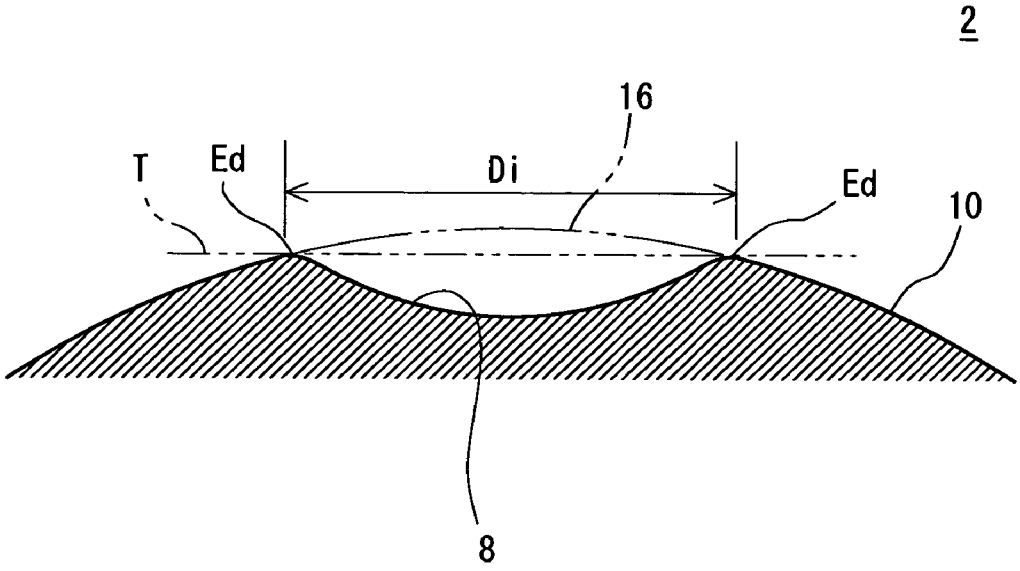
FIG. 5 is an enlarged cross-sectional view illustrating a part of the golf ball shown in FIG. 1.

FIG. 5 is an enlarged cross-sectional view illustrating a part of the golf ball 2 shown in FIG. 1. In FIG. 5, a cross-section along a plane traversing the deepest portion of the dimple 8 and the center of the golf ball 2 is depicted. Vertical direction in FIG. 5 is in-depth direction of the dimple 8. What is indicated by a chain double-dashed line 16 in FIG. 5 is a phantom sphere. The dimple 8 is recessed from the phantom sphere 16. The land 10 agrees with the phantom sphere 16.

What is indicated by a both sided arrowhead Di in FIG. 5 is a diameter of the dimple 8. This diameter Di is a distance between one contact point Ed and another contact point Ed, provided when a common tangent line T to both sides of the dimple 8 is depicted. The contact point Ed is also an edge of the dimple 8. The edge Ed defines the contour of the dimple 8. When it is a noncircular dimple, a circle having the same area as the contour of the noncircular dimple has is assumed, and the diameter of the circle is considered as the diameter of the noncircular dimple.

The following is a definition of the number of kinds of the dimples 8.

N1: the number of kinds of the dimples 8 which are located in the first region Z1 and have a diameter of 3.40 mm or greater N2: the number of kinds of the dimples 8 which are located in the second region Z2 and have a diameter of 3.40 mm or greater N3: the number of kinds of the dimples 8 which are located in the third region Z3 and have a diameter of 3.40 mm or greater N4: the number of kinds of the dimples 8 which are located in the fourth region Z4 and have a diameter of 3.40 mm or greater N5: the number of kinds of the dimples 8 which are located in the fifth region Z5 and have a diameter of 3.40 mm or greater N6: the number of kinds of the dimples 8 which are located in the sixth region Z6 and have a diameter of 3.40 mm or greater N7: the number of kinds of the dimples 8 which are located in the seventh region Z7 and have a diameter of 3.40 mm or greater N8: the number of kinds of the dimples 8 which are located in the eighth region Z8 and have a diameter of 3.40 mm or greater N9: the number of kinds of the dimples 8 which are located in the ninth region Z9 and have a diameter of 3.40 mm or greater NL: the number of kinds of the dimples 8 which are located in the low latitude region ZL and have a diameter of 3.40 mm or greater NH: the number of kinds of the dimples 8 which are located in the high latitude region ZH and have a diameter of 3.40 mm or greater NHm: the number of kinds of the dimples 8 which are located in the middle region ZHm and have a diameter of 3.40 mm or greater NHp: the number of kinds of the dimples 8 which are located in the polar region ZHp and have a diameter of 3.40 mm or greater When determining the number of kinds, the dimples 8 with a diameter of less than 3.40 mm are excluded. It is because the dimples 8 with a small diameter have a small influence on the dimple effect.

Each of the first region Z1 in the northern hemisphere 12 and the first region Z1 in the southern hemisphere 14 includes 12 dimples B, 9 dimples C, 3 dimples D and 6 dimples F. The number of kinds N1 in the first region Z1 is 4.

Each of the second region Z2 in the northern hemisphere 12 and the second region Z2 in the southern hemisphere 14 includes 6 dimples B, 12 dimples C, 8 dimples D and 4 dimples F. The number of kinds N2 in the second region Z2 is 4.

Each of the third region Z3 in the northern hemisphere 12 and the third region Z3 in the southern hemisphere 14 includes 6 dimples B, 7 dimples C, 2 dimples D, 6 dimples E, 4 dimples G and 3 dimples H. The number of kinds N3 in the third region Z3 is 4. When counting the number of kinds N3, the dimples G and the dimples H are excluded.

Each of the fourth region Z4 in the northern hemisphere 12 and the fourth region Z4 in the southern hemisphere 14 includes 20 dimples B and 5 dimples E. The number of kinds N4 in the fourth region Z4 is 2.

Each of the fifth region Z5 in the northern hemisphere 12 and the fifth region Z5 in the southern hemisphere 14 includes 15 dimples A. The number of kinds N5 in the fifth region Z5 is 1.

Each of the sixth region Z6 in the northern hemisphere 12 and the sixth region Z6 in the southern hemisphere 14 includes 10 dimples A. The number of kinds N6 in the sixth region Z6 is 1.

Each of the seventh region Z7 in the northern hemisphere 12 and the seventh region Z7 in the southern hemisphere 14 includes 10 dimples A. The number of kinds N7 in the seventh region Z7 is 1.

Each of the eighth region Z8 in the northern hemisphere 12 and the eighth region Z8 in the southern hemisphere 14 includes 10 dimples E. The number of kinds N8 in the eighth region Z8 is 1.

Each of the ninth region Z9 in the northern hemisphere 12 and the ninth region Z9 in the southern hemisphere 14 includes 5 dimples G and 1 dimple H. The number of kinds N9 in the ninth region Z9 is 0. When counting the number of kinds N9, the dimples G and the dimples H are excluded.

Each of the low latitude region ZL in the northern hemisphere 12 and the low latitude region ZL in the southern hemisphere 14 includes 24 dimples B, 28 dimples C, 13 dimples D, 6 dimples E, 10 dimples F, 4 dimples G and 3 dimples H. The number of kinds NL in the low latitude region ZL is 5. When counting the number of kinds NL, the dimples G and the dimples H are excluded.

Each of the high latitude region ZH in the northern hemisphere 12 and the high latitude region ZH in the southern hemisphere 14 includes 35 dimples A, 20 dimples B, 15 dimples E, 5 dimples H and 1 dimple G. The number of kinds NH in the high latitude region ZH is 3. When counting the number of kinds NH, the dimples G and the dimples H are excluded.

Each of the middle region ZHm in the northern hemisphere 12 and the middle region ZHm in the southern hemisphere 14 includes 25 dimples A, 20 dimples B and 5 dimples E. The number of kinds NHm in the middle region ZHm is 3.

Each of the polar region ZHp in the northern hemisphere 12 and the polar region ZHp in the southern hemisphere 14 includes 10 dimples A, 10 dimples E, 5 dimples G and 1 dimple H. The number of kinds NHp in the polar region ZHp is 2. When counting the number NHp of the kinds, the dimples G and the dimples H are excluded.

In the present invention, a belonging of the dimples 8 which are located crossing the boundary is determined depending on the position of the center (the area center of gravity) of the dimple 8. For example, the dimple 8 that intersects the second latitude line L2 and has a latitude of the center of 0 degree or greater and less than 10 degrees belongs to the first region Z1, not to the second region Z2.

The golf ball 2 meets the above mentioned formula (I). In other words, the number of kinds NL in the low latitude region ZL is equal to or greater than the number of kinds NH in the high latitude region ZH. The golf ball 2 meets the above mentioned formula (II). In other words, the number of kinds NL in the low latitude region ZL is greater than the number of kinds NHm in the middle region ZHm, and greater than the number of kinds NHp in the polar region ZHp. Further, the number of kinds NHm in the middle region ZHm is equal to or greater than the number of kinds NHp in the polar region ZHp. In the golf ball 2, the number of kinds is biased. In the golf ball 2, the number of kinds in the vicinity of the equator is great. In the vicinity of an equator, dimples tend to be arranged orderly. The orderly arrangement deteriorates the dimple effect. In the golf ball 2 according to the present invention, the dimples 8 are not easily arranged orderly because many kinds of the dimples 8 are arranged in the vicinity of the equator. Moreover, even when the centers of the dimples 8 on the golf ball 2 are aligned, their contours are not arranged orderly. Using many kinds of the dimples supplies the dimple effect in the vicinity of the equator. With the golf ball 2, a great flight distance is achieved. In the golf ball 2, the dimple effect achieved when a portion that has the fastest circumferential velocity of the backspin is on the equator, is equal to the dimple effect achieved in the other circumstances. In the golf ball 2, the flight distance does not depend on the rotation axis. The golf ball 2 is excellent in aerodynamic symmetry.

In light of the dimple effect, the difference (NL−NH) between the number of kinds NL and the number of kinds NH is more preferably equal to or greater than 1 and particularly preferably equal to or greater than 2. In the golf ball 2 shown in FIG. 1 to FIG. 5, the number of kinds NL is 5 and the number of kinds NH is 3. Accordingly, the difference (NL−NH) is 2.

In light of the dimple effect, the difference (NL−NHm) between the number of kinds NL and the number of kinds NHm is more preferably equal to or greater than 2. In the golf ball 2 shown in FIG. 1 to FIG. 5, the number of kinds NL is 5 and the number of kinds NHm is 3. Accordingly, the difference (NL−NHm) is 2.

In light of the dimple effect, the difference (NL−NHp) between the number of kinds NL and the number of kinds NHp is more preferably equal to or greater than 2 and particularly preferably equal to or greater than 3. In the golf ball 2 shown in FIG. 1 to FIG. 5, the number of kinds NL is 5 and the number of kinds NHp is 2. Accordingly, the difference (NL−NHp) is 3.

In light of the dimple effect, it is preferable that the golf ball 2 meets the above mentioned formula (III). In other words, the difference between the number of kinds NHm and the number of kinds NHp, (NHm−NHp), is preferably equal to or greater than 1. In the golf ball 2 shown in FIG. 1 to FIG. 5, the number of kinds NHm is 3 and the number of kinds NHp is 2. Accordingly, the difference (NHm−NHp) is 1.

In light of the dimple effect, it is preferable that the golf ball 2 meets the above mentioned formula (IV). In the golf ball 2 shown in FIG. 1 to FIG. 5, the number of kinds N1 is 4, the number of kinds N2 is 4, the number N3 of the kinds is 4, the number of kinds N4 is 2, the number of kinds N5 is 1, the number of kinds N6 is 1, the number of kinds is N7, the number of kinds N8 is 1 and the number of kinds N9 of 0. The golf ball 2 meets the following formula (V).

$$N1=N2=N3>N4>N5=N6=N7=N8=N9 \quad (V)$$

Accordingly, the golf ball 2 meets the above mentioned formula (IV). More preferably, the golf ball 2 meets the following formula (VI).

$$N1\geqq N2\geqq N3>N4\geqq N5\geqq N6>N7\geqq N8\geqq N9 \quad (VI)$$

In the low latitude region ZL, the number of the dimples 8 is 88. As the number of the dimples B in the low latitude region ZL is 24, a ratio of the dimples B in number is 27.3%. The number of the dimples C is 28 and a ratio of the dimples C in number is 31.8%. The number of the dimples D is 13 and a ratio of the dimples D in number is 14.8%. The number of the dimples E is 6 and a ratio of the dimples E in number is 6.8%. The number of the dimples F is 10 and a ratio of the dimples F in number is 11.4%. In light of the dimple effect, it is preferable that the ratio of the dimple 8 in number is equal to or greater than 5% in every kind when the dimples 8 are included in the low latitude region ZL and have a diameter of equal to or greater than 3.40 mm.

In the high latitude region ZH, the number of the dimples 8 is 76. As the number of the dimples A in the high latitude region ZH is 35, a ratio of the dimples A in number is 46.1%. The number of the dimples B is 20 and a ratio of the dimples B in number is 26.3%. The number of the dimples E is 15 and a ratio of the dimples E in number is 19.7%. In light of the dimple effect, it is preferable that the ratio of the number of the dimples 8 included in the high latitude region ZH and having a diameter of equal to or greater than 3.40 mm is equal to or greater than 5% in every kind.

In the middle region ZHm, the number of the dimples 8 is 50. As the number of the dimples A in the middle region ZHm is 25, a ratio of the dimples A in number is 50.0%. The number of the dimples B is 20 and a ratio of the dimple B in number is 40.0%. The number of the dimples E is 5 and a ratio of the dimples E in number is 10.0%. In light of the dimple effect, it is preferable that the ratio of the number of the dimples 8 included in the middle region ZHm and having a diameter of equal to or greater than 3.40 mm is equal to or greater than 5% in every kind.

In the polar region ZHp, the number of the dimples 8 is 26. As the number of the dimples A in the polar region ZHp is 10, a ratio of the dimples A in number is 38.5%. The number of the dimples E is 10 and a ratio of the dimples E in number is 38.5%. In light of the dimple effect, it is preferable that the ratio of the number of the dimples 8 included in the polar region ZHp and having a diameter of equal to or greater than 3.40 mm is equal to or greater than 5% in every kind.

When the dimples 8 which are in the low latitude region ZL and have a diameter of equal to or greater than 3.40 mm are arranged in decreasing order of the diameter, a ratio (Dx/Dn) of a mean diameter Dx of the dimples 8 ranked in the top 10% to a mean diameter Dn of the dimples 8 ranked in the bottom 10% is preferably equal to or greater than 1.10. By setting the ratio (Dx/Dn) to be equal to or greater than 1.10, a great dimple effect in the vicinity of the equator is achieved. In this respect, the ratio (Dx/Dn) is more preferably equal to or greater than 1.12 and particularly preferably equal to or greater than 1.14. The ratio (Dx/Dn) is preferably equal to or less than 1.80. In the golf ball 2 shown in FIG. 1 to FIG. 5, the low latitude region ZL has 24 dimples B and 10 dimples F. As the number of the dimples 8 having a diameter of equal to or greater than 3.40 mm in the low latitude region ZL is 81, 8 dimples B correspond to the dimples 8 in the top 10% and 8 dimples F correspond to the dimples 8 in the bottom 10%. Accordingly, the ratio (Dx/Dn) is 1.14.

From the standpoint that a sufficient dimple effect is achieved, the total number of the dimples 8 is preferably equal to or greater than 300, more preferably equal to or greater than 310 and particularly preferably equal to or greater than 320. From the standpoint that each of the dimples 8 can have a sufficient diameter, the total number of the dimples 8 is preferably equal to or less than 500, more preferably equal to or less than 480 and particularly preferably equal to or less than 460.

In light of the dimple effect, a ratio Pn of the number of the dimples 8 with a diameter of equal to or greater than 3.40 mm to the total number of the dimples 8 is preferably equal to or greater than 90% and particularly preferably equal to or greater than 92%. Ideally, the ratio Pn is 100%. The golf ball 2 shown in FIG. 1 to FIG. 5 has the ratio Pn of 92.1%.

The golf ball 2 according to the present invention has three or more kinds of the dimples 8, each having a different diameter. By setting the number of kinds to be equal to or greater than 3, a great dimple effect is obtained. In this respect, the number of kinds is preferably equal to or greater than 4 and particularly preferably equal to or greater than 5. In light of ease of production, the number of the kinds is preferably equal to or less than 16. The golf ball 2 shown in FIG. 1 to FIG. 5 has 8 kinds of the dimples 8 designated as A to H.

In light of the dimple effect, the number of the kinds of the dimples 8 having a diameter of equal to or greater than 3.40 mm is preferably equal to or greater than 3, more preferably equal to or greater than 4 and particularly preferably equal to or greater than 5. In light of ease of production, the number of the kinds of the dimples 8 having a diameter of equal to or greater than 3.40 mm is preferably equal to or less than 16. The golf ball 2 shown in FIG. 1 to FIG. 5 has 6 kinds of the dimples 8 designated as A to F. The dimples 8 have a diameter of equal to or greater than 3.40 mm.

When two dimples 8 have an equal diameter and a different depth, both of the dimples 8 belong to the same kind. When two dimples 8 have an equal diameter and a different shape of cross-section, both of the two dimples 8 belong to the same kind.

Due to the error caused during the production and measurement, various actual measurement values of the diameter are obtained. In the present invention, when a diameter of the dimple 8 has a difference between an actual measurement value and a design value of less than ±0.05 mm, the diameter of the dimple 8 is considered to have the design value. In the present invention, a diameter of the dimples 8 is measured on the golf ball 2 without being applied any paint. The diameter may be measured on the golf ball 2 after a paint layer is removed.

In light of the dimple effect, a diameter of the dimples 8 of which the diameter is less than 3.40 mm is preferably equal to or greater than 2.0 mm, more preferably equal to or greater than 2.50 mm and particularly preferably equal to or greater than 3.00 mm. In light of the dimple effect, a diameter of the dimples 8 of which the diameter is equal to or greater than 3.40 mm is preferably equal to or greater than 3.60 mm and more preferably equal to or greater than 3.8 mm. The diameter is preferably equal to or less than 6.00 mm. By setting the diameter to be equal to or less than 6.00 mm, a fundamental feature of the golf ball 2 which is substantially a sphere is maintained. In this respect, the diameter is more preferably equal to or less than 5.80 and particularly preferably equal to or less than 5.60 mm.

The area s of the dimple 8 is an area of a region surrounded by the contour line when the center of the golf ball 2 is viewed at infinity. When the dimples 8 are circular, the area s is calculated by the following formula.

$$s=(Di/2)^2\cdot\pi$$

In the golf ball 2 shown in FIG. 1 to FIG. 5, an area of the dimple A is 16.62 $mm^2$, an area of the dimple B is 15.55 $mm^2$, an area of the dimple C is 14.52 $mm^2$, an area of the dimple D is 13.85 $mm^2$, an area of the dimple E is 13.20 $mm^2$, an area of the dimple F is 11.95 $mm^2$' an area of the dimple G is 8.04 $mm^2$ and an area of the dimple H is 7.07 $mm^2$.

In the present invention, a ratio of summation of the areas s of all the dimples 8 to the surface area of the phantom sphere 16 is referred to as an occupation ratio. From the standpoint that a sufficient dimple effect is achieved, the occupation ratio is preferably equal to or greater than 70%, more preferably equal to or greater than 72%, and particularly preferably equal to or greater than 74%. The occupation ratio is preferably equal to or less than 88% and more preferably equal to or less than 86%. The golf ball 2 shown in FIG. 1 to FIG. 5 has the total area of the dimples 8 of 4700.2 $mm^2$. Because the surface area of the phantom sphere 16 of this golf ball 2 is 5728.0 $mm^2$, the occupation ratio is 82.1%.

In the present invention, "volume of the dimple" means a volume surrounded by a plane including the contour of the dimple 8 and the surface of the dimple 8. In light of reduction of a hopping of the golf ball 2, the total volume of the dimple 8 is preferably equal to or greater than 250 $mm^3$, more preferably equal to or greater than 260 $mm^3$ and particularly preferably equal to or greater than 270 $mm^3$. In light of reduction of a dropping of the golf ball 2, the total volume is preferably equal to or less than 400 $mm^3$, more preferably equal to or less than 390 $mm^3$ and particularly equal to or less than 380 $mm^3$.

In light of reduction of a hopping of the golf ball 2, a depth of the dimple 8 is preferably equal to or greater than 0.05 mm, more preferably equal to or greater than 0.08 mm and particularly preferably equal to or greater than 0.10 mm. In light of reduction of a dropping of the golf ball 2, the depth is preferably equal to or less than 0.60 mm, more preferably equal to or less than 0.45 mm and particularly equal to or less than 0.40 mm. The depth is a distance between the tangent line T and the deepest portion of the dimple 8.

EXAMPLES

Example

A rubber composition was obtained by kneading 100 parts by weight of polybutadiene (trade name "BR-730", available from JSR Corporation), 30 parts by weight of zinc diacrylate, 6 parts of zinc oxide, 10 parts by weight of barium sulfate, 0.5 part by weight of diphenyl disulfide and 0.5 part by weight of dicumyl peroxide. This rubber composition was placed into a mold having upper and lower mold half each having a hemispherical cavity, and heated at 170° C. for 18 minutes to obtain a core having a diameter of 39.7 mm. On the other hand, 50 parts by weight of an ionomer resin (available from Du Pont-MITSUI POLYCHEMICALS Co., Ltd.; trade name "Himilan 1605"), 50 parts by weight of other ionomer resin (available from Du Pont-MITSUI POLYCHEMICALS Co., Ltd.; trade name "Himilan 1706") and 3 parts by weight of titanium dioxide were kneaded to obtain a resin composition. The aforementioned core was placed into a final mold having numerous pimples on the inside face, followed by injection of the aforementioned resin composition around the core by injection molding to form a cover having a thickness of 1.5 mm. Numerous dimples having a shape inverted from the shape of the pimple were formed on the cover. A clear paint including a two-part liquid curable polyurethane as a base was applied on this cover to give a golf ball of Example having a diameter of 42.7 mm and a weight of about 45.4 g. This golf ball had a PGA compression of about 85. This golf ball has a dimple pattern shown in FIG. 2 to FIG. 4. Details of specifications of the dimples are shown in Table 1 below. Distribution of the dimples is shown in Table 3 below.

Comparative Examples 1 to 6

Golf balls of Comparative Examples 1 to 6 were obtained in a similar manner to Example except that the dimples were formed by changing the final mold so that their specifications were as shown in Tables 1 and 2 below. Distribution of the dimples is shown in Tables 3 and 4 below.

TABLE 1

Figure 6:
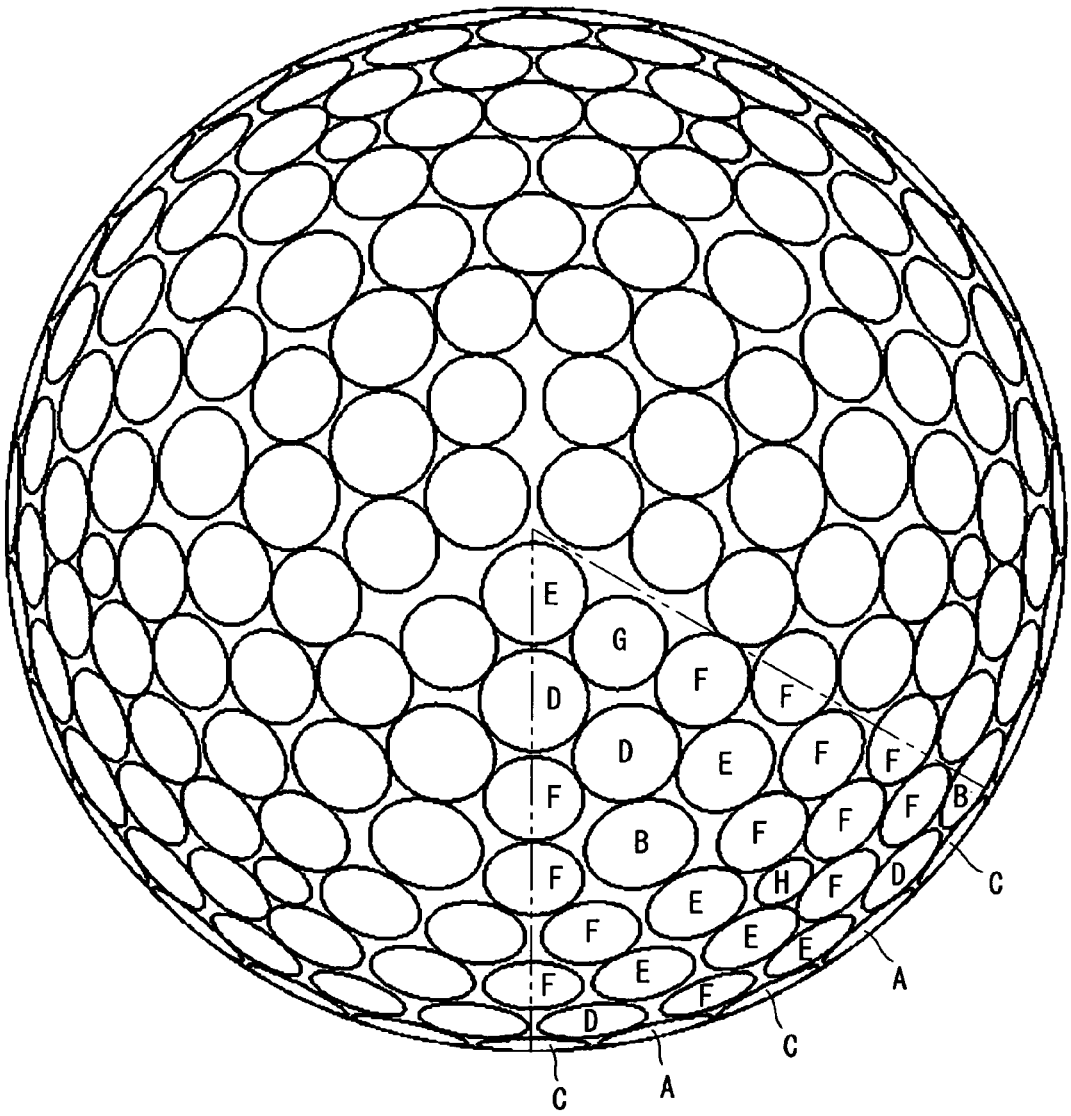
FIG. 6 is a plane view illustrating a golf ball of a Comparative Example 1.
Figure 7:
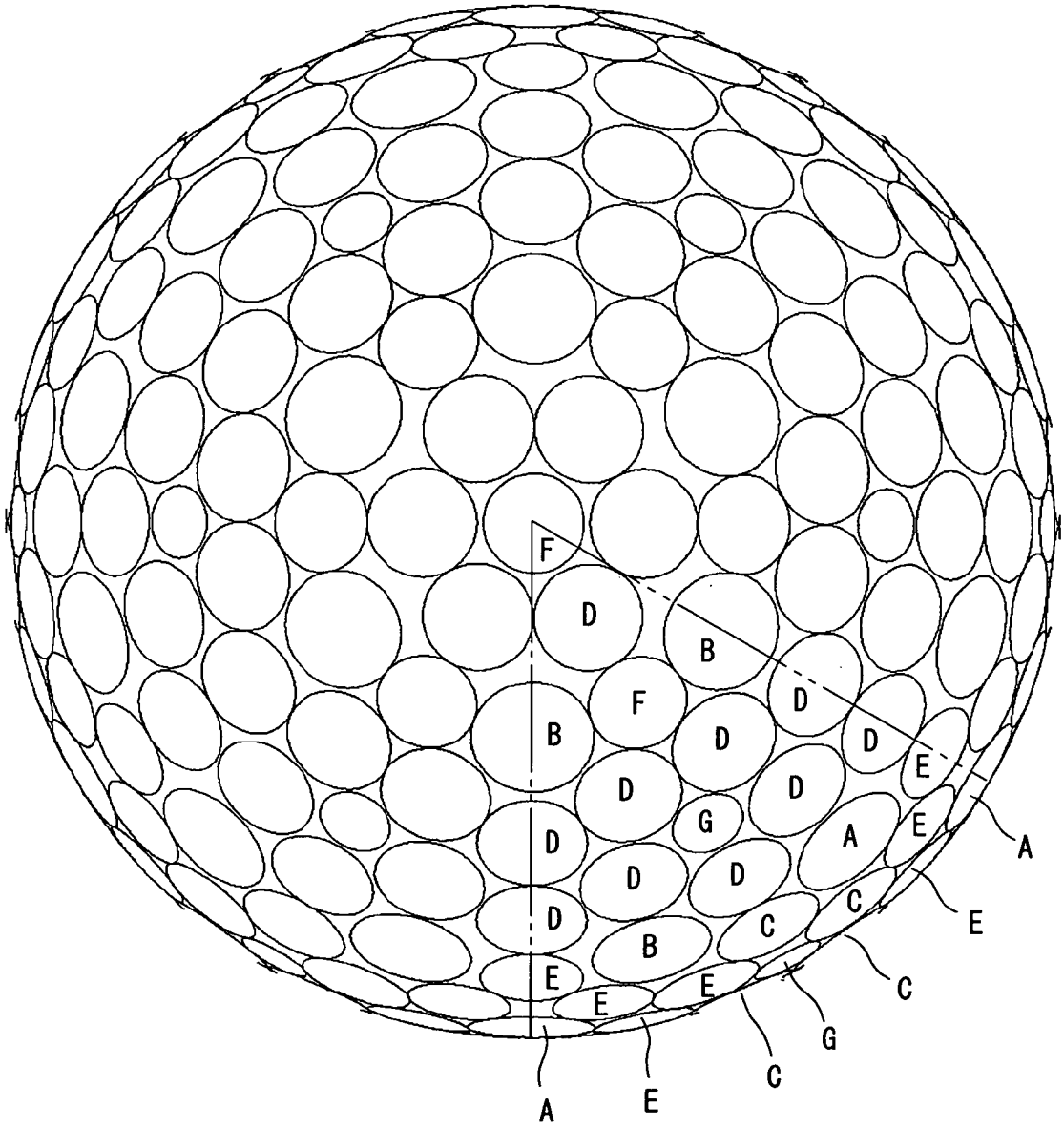
FIG. 7 is a plane view illustrating a golf ball of a Comparative Example 2.

| | Specifications of dimples | | | | | | | |
|---|---|---|---|---|---|---|---|---|
| | Kind | Number | Diameter (mm) | Depth (mm) | Curvature (mm) | Volume ($mm^3$) | Total volume ($mm^3$) | Plane view |
| Example | A | 70 | 4.60 | 0.1380 | 19.24 | 1.148 | 324.8 | FIG. 2 |
| | B | 88 | 4.45 | 0.1380 | 18.01 | 1.075 | | |
| | C | 56 | 4.30 | 0.1380 | 16.82 | 1.003 | | |
| | D | 26 | 4.20 | 0.1380 | 16.05 | 0.957 | | |
| | E | 42 | 4.10 | 0.1380 | 15.30 | 0.912 | | |
| | F | 20 | 3.90 | 0.1380 | 13.85 | 0.826 | | |
| | G | 18 | 3.20 | 0.1380 | 9.34 | 0.556 | | |
| | H | 8 | 3.00 | 0.1380 | 8.22 | 0.489 | | |
| Comp. | A | 24 | 4.70 | 0.1430 | 19.38 | 1.242 | 324.7 | FIG. 6 |
| Example 1 | B | 18 | 4.60 | 0.1430 | 18.57 | 1.190 | | |
| | C | 30 | 4.50 | 0.1430 | 17.77 | 1.139 | | |
| | D | 42 | 4.40 | 0.1430 | 16.99 | 1.089 | | |
| | E | 66 | 4.20 | 0.1430 | 15.49 | 0.992 | | |
| | F | 126 | 4.00 | 0.1430 | 14.06 | 0.900 | | |
| | G | 12 | 3.90 | 0.1430 | 13.37 | 0.856 | | |
| | H | 12 | 2.60 | 0.1380 | 6.19 | 0.368 | | |
| Comp. | A | 24 | 5.15 | 0.1400 | 23.75 | 1.460 | 325.2 | FIG. 7 |
| Example 2 | B | 24 | 5.00 | 0.1390 | 22.55 | 1.366 | | |
| | C | 60 | 4.60 | 0.1390 | 19.10 | 1.156 | | |
| | D | 96 | 4.50 | 0.1390 | 18.28 | 1.107 | | |
| | E | 60 | 4.20 | 0.1390 | 15.93 | 0.964 | | |
| | F | 14 | 4.10 | 0.1390 | 15.19 | 0.919 | | |
| | G | 24 | 2.90 | 0.1390 | 7.63 | 0.460 | | |

TABLE 2

Figure 8:
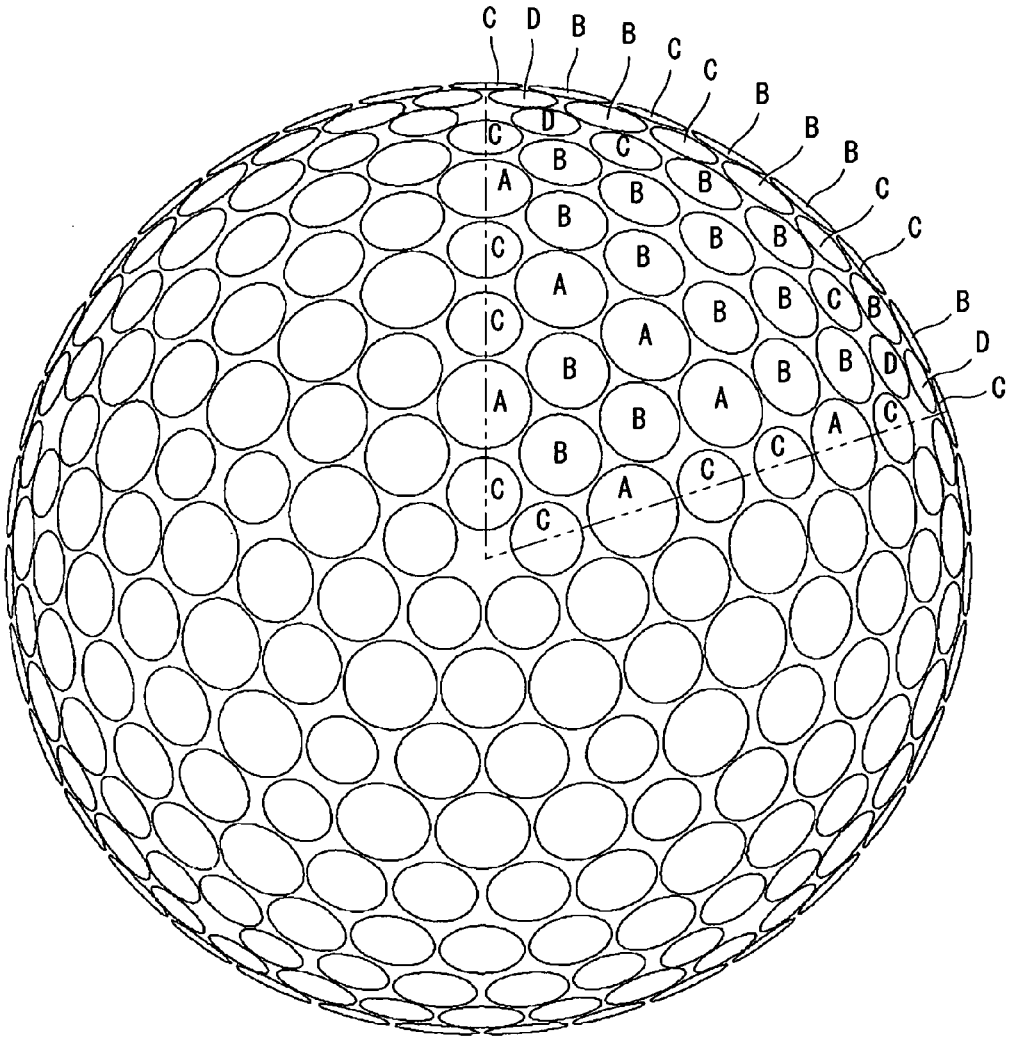
FIG. 8 is a plane view illustrating a golf ball of a Comparative Example 3.
Figure 9:
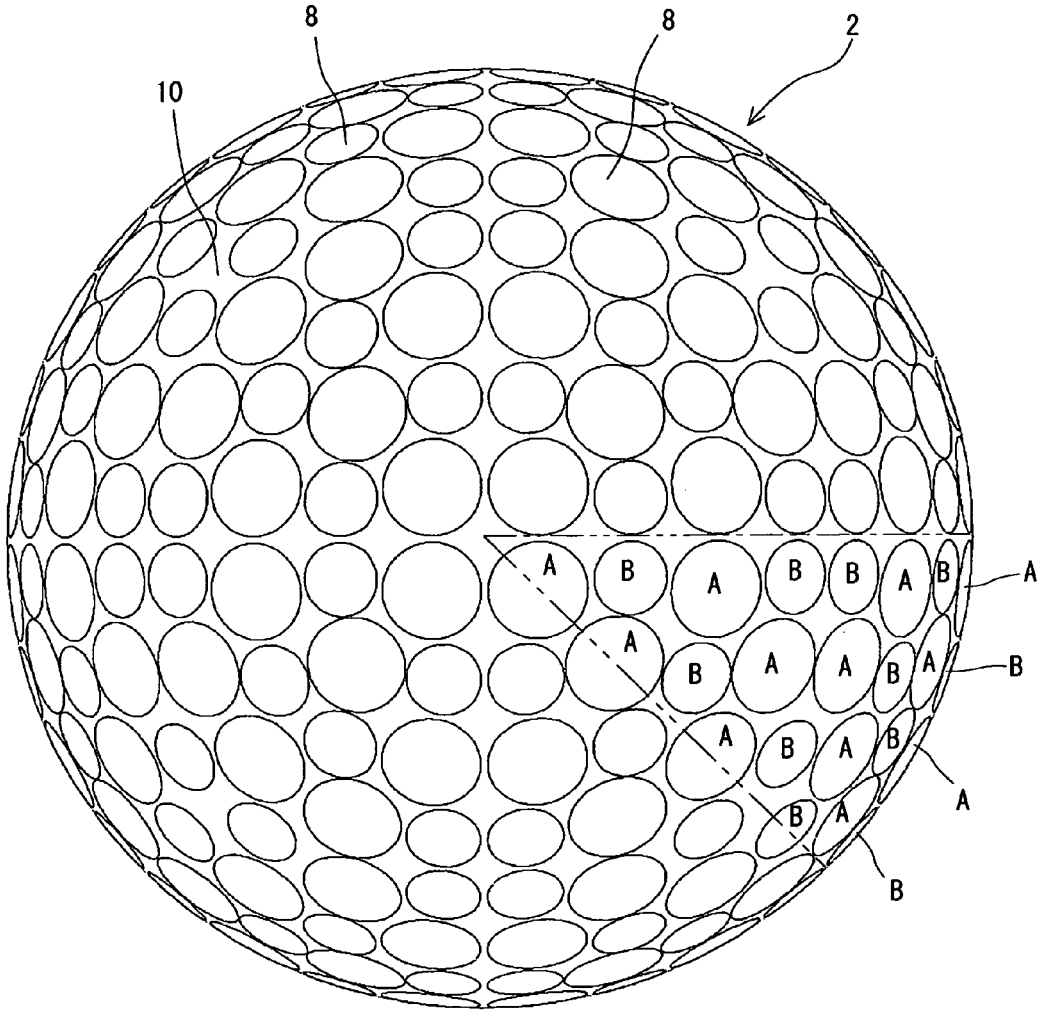
FIG. 9 is a plane view illustrating a golf ball of a Comparative Example 4.
Figure 10:
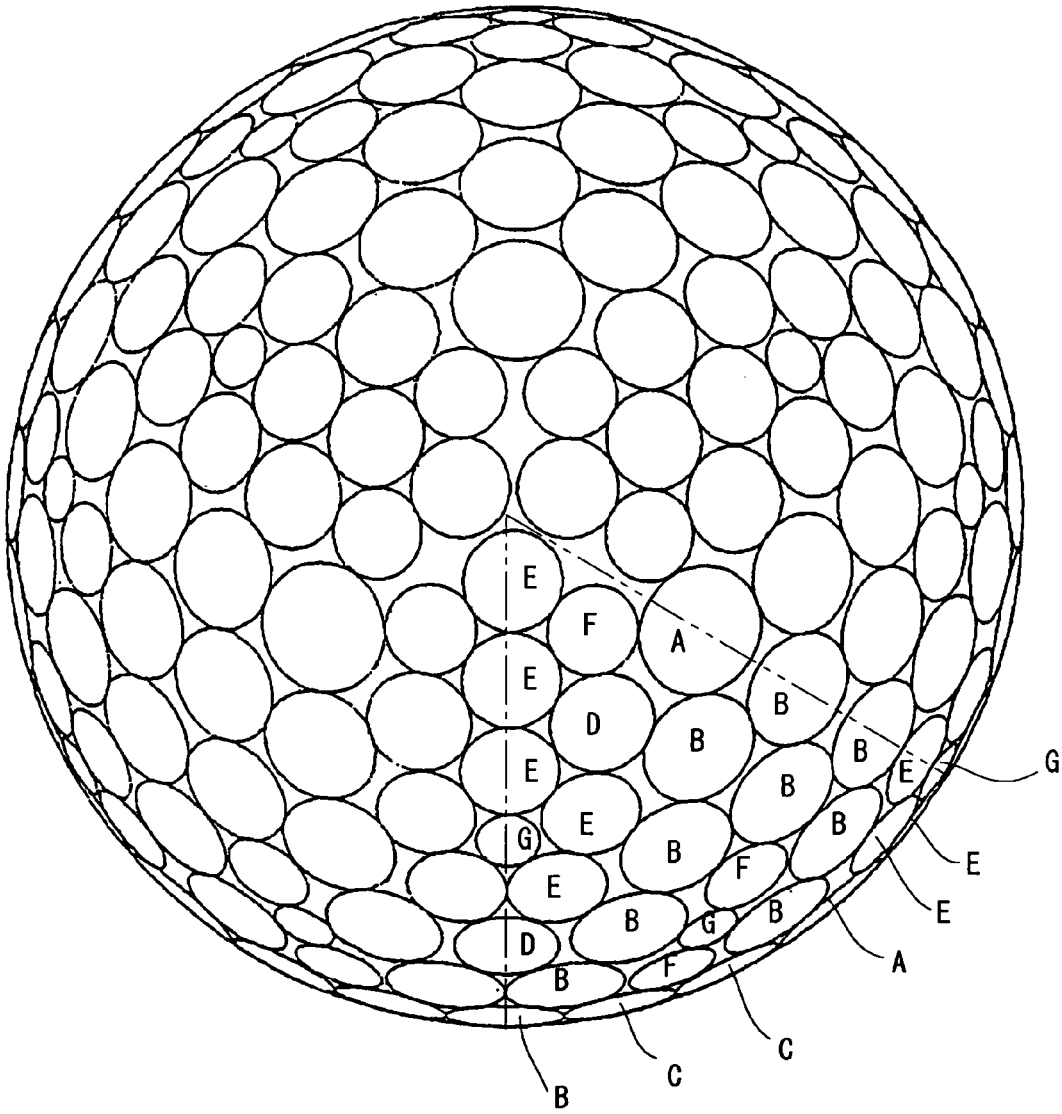
FIG. 10 is a plane view illustrating a golf ball of a Comparative Example 5.
Figure 11:
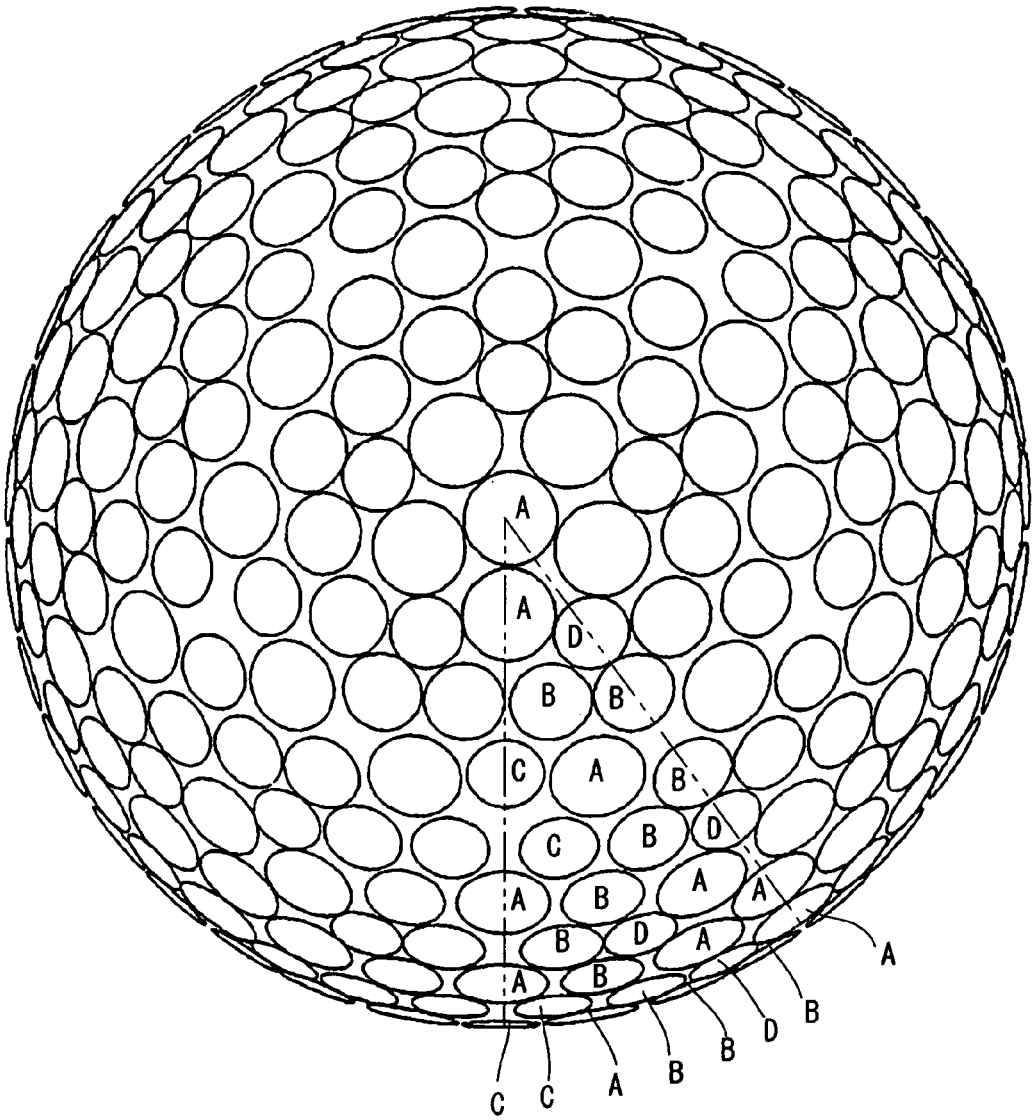
FIG. 11 is a plane view illustrating a golf ball of a Comparative Example 6.

| | Specifications of dimples | | | | | | | |
|---|---|---|---|---|---|---|---|---|
| | Kind | Number | Diameter (mm) | Depth (mm) | Curvature (mm) | Volume ($mm^3$) | Total volume ($mm^3$) | Plane view |
| Comp. | A | 50 | 4.20 | 0.1530 | 14.49 | 1.062 | 324.5 | FIG. 8 |
| Example 3 | B | 210 | 3.75 | 0.1520 | 11.64 | 0.841 | | |
| | C | 110 | 3.30 | 0.1520 | 9.03 | 0.652 | | |
| | D | 40 | 3.10 | 0.1520 | 7.98 | 0.575 | | |
| Comp. | A | 168 | 4.60 | 0.1480 | 17.95 | 1.232 | 325.2 | FIG. 9 |
| Example 4 | B | 168 | 3.50 | 0.1460 | 10.56 | 0.704 | | |
| Comp. | A | 18 | 5.60 | 0.1350 | 29.10 | 1.664 | 325.3 | FIG. 10 |
| Example 5 | B | 102 | 5.10 | 0.1340 | 24.33 | 1.370 | | |
| | C | 24 | 4.85 | 0.1340 | 22.01 | 1.239 | | |
| | D | 18 | 4.50 | 0.1340 | 18.96 | 1.067 | | |
| | E | 72 | 4.25 | 0.1340 | 16.92 | 0.952 | | |
| | F | 36 | 3.90 | 0.1340 | 14.26 | 0.802 | | |
| | G | 24 | 2.75 | 0.1300 | 7.34 | 0.387 | | |
| Comp. | A | 132 | 4.10 | 0.1420 | 14.87 | 0.939 | 324.9 | FIG. 11 |
| Example 6 | B | 180 | 3.55 | 0.1420 | 11.16 | 0.704 | | |

TABLE 2-continued

| Specifications of dimples | | | | | | | |
|---|---|---|---|---|---|---|---|
| Kind | Number | Diameter (mm) | Depth (mm) | Curvature (mm) | Volume ($mm^3$) | Total volume ($mm^3$) | Plane view |
| C | 60 | 3.40 | 0.1420 | 10.25 | 0.646 | | |
| D | 60 | 3.25 | 0.1420 | 9.37 | 0.590 | | |

TABLE 3

| Distribution of dimples | | | | | | | | | | |
|---|---|---|---|---|---|---|---|---|---|---|
| | Kind | First region | Second region | Third region | Fourth region | Fifth region | Sixth region | Seventh region | Eighth region | Ninth region |
| Example | A | — | — | — | — | 30 | 20 | 20 | — | — |
| | B | 24 | 12 | 12 | 40 | — | — | — | — | — |
| | C | 18 | 24 | 14 | — | — | — | — | — | — |
| | D | 6 | 16 | 4 | — | — | — | — | — | — |
| | E | — | — | 12 | 10 | — | — | — | 20 | — |
| | F | 12 | 8 | — | — | — | — | — | — | — |
| | G | — | — | 8 | — | — | — | — | — | 10 |
| | H | — | — | 6 | — | — | — | — | — | 2 |
| Comp. Example 1 | A | 24 | — | — | — | — | — | — | — | — |
| | B | — | 6 | — | — | — | 12 | — | — | — |
| | C | 30 | — | — | — | — | — | — | — | — |
| | D | — | 24 | — | — | — | — | 12 | 6 | — |
| | E | — | 12 | 24 | 12 | — | 12 | — | — | 6 |
| | F | — | 12 | 30 | 30 | 30 | 12 | 12 | — | — |
| | G | — | — | — | — | — | — | — | 12 | — |
| | H | — | — | — | 12 | — | — | — | — | — |
| Comp. Example 2 | A | 12 | — | — | 12 | — | — | — | — | — |
| | B | — | — | — | 12 | — | — | 12 | — | — |
| | C | 24 | 24 | 12 | — | — | — | — | — | — |
| | D | — | — | — | 24 | 24 | 36 | — | 12 | — |
| | E | 24 | 24 | 12 | — | — | — | — | — | — |
| | F | — | — | — | — | — | — | 12 | — | 2 |
| | G | — | 12 | — | — | 12 | — | — | — | — |

TABLE 4

| Distribution of dimples | | | | | | | | | | |
|---|---|---|---|---|---|---|---|---|---|---|
| | Kind | First region | Second region | Third region | Fourth region | Fifth region | Sixth region | Seventh region | Eighth region | Ninth region |
| Comp. Example 3 | A | — | — | — | 10 | — | 30 | — | 10 | — |
| | B | 40 | 30 | 20 | 50 | 40 | — | 20 | 10 | — |
| | C | 30 | 20 | 30 | — | 10 | — | 10 | — | 10 |
| | D | — | 20 | 20 | — | — | — | — | — | — |
| Comp. Example 4 | A | 32 | 32 | 32 | 16 | 24 | — | 24 | — | 8 |
| | B | 32 | 32 | 24 | 32 | 16 | 16 | — | 16 | — |
| Comp. Example 5 | A | 12 | — | — | — | — | — | 6 | — | — |
| | B | 6 | 12 | 24 | 30 | 18 | 12 | — | — | — |
| | C | 24 | — | — | — | — | — | — | — | — |
| | D | — | — | — | 6 | — | — | 12 | — | — |
| | E | 12 | 12 | 6 | — | 12 | 12 | 6 | 6 | 6 |
| | F | — | 12 | — | 12 | — | — | — | 12 | — |
| | G | — | 6 | 12 | — | — | 6 | — | — | — |
| Comp. Example 6 | A | 20 | 10 | 40 | 20 | 10 | 20 | — | 10 | 2 |
| | B | 40 | 20 | 20 | 40 | 20 | 10 | 30 | — | — |
| | C | 10 | 20 | — | — | 20 | 10 | — | — | — |
| | D | — | 20 | 20 | — | 10 | — | — | 10 | — |

[Flight Distance Test]

A driver with a titanium head (trade name "XXIO", available from SUMITOMO RUBBER INDUSTRIES, LTD., shaft hardness: X, loft angle: 9°) was attached to a swing machine, available from True Temper Co. Then the golf ball was hit under the condition to provide a head speed of 49 m/sec, a launch angle being about 11° and give the backspin rate of about 3000 rpm. Accordingly, the distance from the launching point to the point where the ball stopped was measured. The condition during the test was almost windless. Mean values of 20 times measurement with each of pole hitting and seam hitting are shown in Table 5 below. In the pole hitting, the golf ball is hit such that a straight line on a plane including the equator is a rotation axis of the backspin. In the seam hitting, the golf ball is hit such that a straight line connecting both of the poles P is a rotation axis of the backspin.

TABLE 5

| | Results of evaluation | | | | | | |
|---|---|---|---|---|---|---|---|
| | Example | Comp. Example 1 | Comp. Example 2 | Comp. Example 3 | Comp. Example 4 | Comp. Example 5 | Comp. Example 6 |
| Number of kinds | | | | | | | |
| N1 | 4 | 2 | 3 | 2 | 2 | 4 | 3 |
| N2 | 4 | 4 | 2 | 2 | 2 | 3 | 3 |
| N3 | 4 | 2 | 2 | 2 | 2 | 2 | 2 |
| N4 | 2 | 2 | 3 | 2 | 2 | 3 | 2 |
| N5 | 1 | 1 | 1 | 2 | 2 | 2 | 3 |
| N6 | 1 | 3 | 1 | 1 | 1 | 2 | 3 |
| N7 | 1 | 2 | 2 | 2 | 1 | 3 | 1 |
| N8 | 1 | 2 | 1 | 2 | 1 | 2 | 1 |
| N9 | 0 | 1 | 1 | 1 | 1 | 1 | 1 |
| NL | 5 | 6 | 3 | 2 | 2 | 5 | 3 |
| NH | 3 | 5 | 4 | 3 | 2 | 5 | 3 |
| NHm | 3 | 3 | 3 | 3 | 2 | 4 | 3 |
| NHp | 2 | 4 | 3 | 3 | 2 | 4 | 2 |
| Total number of dimples | 328 | 330 | 302 | 410 | 336 | 294 | 432 |
| Ratio Pn (%) | 92.1 | 96.4 | 92.1 | 90.2 | 100 | 91.8 | 86.1 |
| Flight distance (m) | | | | | | | |
| Pole hitting | 234.0 | 232.8 | 231.9 | 230.9 | 229.5 | 231.4 | 229.3 |
| Seam hitting | 233.4 | 231.4 | 230.3 | 229.0 | 227.2 | 229.3 | 227.6 |
| Difference | 0.6 | 1.4 | 1.6 | 1.9 | 2.3 | 2.1 | 1.7 |

As shown in Table 5, a flight distance of the golf ball in Example is great. Moreover, the golf ball in Example has a small difference between flight distances with the pole hitting and the seam hitting. Accordingly, advantages of the present invention are clearly indicated by these results of evaluation.

The dimple pattern according to the present invention can be applied to not only two-piece golf balls, but also one-piece golf balls, multi-piece golf balls and wound golf balls. The foregoing description is just for illustrative examples, and various modifications can be made in the scope without departing from the principles of the present invention.

What is claimed is:

1. A golf ball which comprises three or more kinds of dimples, each having a different diameter, on the surface thereof, a total number of the dimples being 300 or more, a ratio Pn of a number of the dimples with a diameter of equal to or greater than 3.40 mm to the total number of the dimples being equal to or greater than 90%, NL and NH, which represent a number of kinds of the dimples, meeting the following formula (I), NL, NHm and NHp, which represent a number of kinds of the dimples, meeting the following formula (II), $$NL-NH \geqq 0 \quad \text{(I)}$$

(In this formula (I), NL represents a number of kinds of the dimples being located in a low latitude region whose latitude is 0 degree or greater and less than 30 degrees, and having a diameter of equal to or greater than 3.40 mm and NH represents a number of kinds of the dimples being located in a high latitude region whose latitude is 30 degrees or greater and 90 degrees or less, and having a diameter of equal to or greater than 3.40 mm)

$$NL>NHm \geqq NHp \quad \text{(II)}$$

(In this formula (II), NL represents a number of kinds of the dimples being located in the low latitude region whose latitude is 0 degree or greater and less than 30 degrees, and having a diameter of equal to or greater than 3.40 mm; NHm represents a number of kinds of the dimples being located in a middle region whose latitude is 30 degrees or greater and less than 60 degrees, and having a diameter of equal to or greater than 3.40 mm; and NHp represents a number of kinds of the dimples being located in a polar region whose latitude is 60 degrees or greater and 90 degrees or less, and having a diameter of equal to or greater than 3.40 mm).

2. The golf ball according to claim 1 wherein NL, NHm and NHp, which represent a number of kinds of the dimples, meet the following formula (III), $$NL>NHm>NHp \quad \text{(III)}.$$

3. The golf ball according to claim 1 wherein N1 to N9, which represent a number of kinds of the dimples, meet the following formula (IV), $$N1 \geqq N2 \geqq N3 > N4 \geqq N5 \geqq N6 \geqq N7 \geqq N8 \geqq N9 \quad \text{(IV)}$$

(In this formula (IV), N1 represents a number of kinds of the dimples being located in a first region whose latitude is 0 degree or greater and less than 10 degrees, and having a diameter of equal to or greater than 3.40 mm; N2 represents a number of kinds of the dimples being located in a second region whose latitude is 10 degrees or greater and less than 20 degrees, and having a diameter of equal to or greater than 3.40 mm; N3 represents a number of kinds of the dimples being located in a third region whose latitude is 20 degrees or greater and less than 30 degrees, and having a diameter of equal to or greater than 3.40 mm; N4 represents a number of kinds of the dimples being located in a fourth region whose latitude is 30 degrees or greater and less than 40 degrees, and having a diameter of equal to or greater than 3.40 mm; N5 represents a number of kinds of the dimples being located in a fifth region whose latitude is 40 degrees or greater and less than 50 degrees, and having a diameter of equal to or greater than 3.40 mm; N6 represents a number of kinds of the dimples being located in a sixth region whose latitude is 50 degrees or greater and less than 60 degrees, and having a diameter of equal to or greater than 3.40 mm; N7 represents a number of kinds of the dimples being located in a seventh region whose latitude is 60 degrees or greater and less than 70 degrees, and having a diameter of equal to or greater than 3.40 mm; N8 represents a number of kinds of the dimples being located in an eighth region whose latitude is 70 degrees or greater and less than 80 degrees, and having a diameter of equal to or greater than 3.40 mm; and N9 represents a number of kinds of the dimples being located in a ninth region whose latitude is 80 degrees or greater and 90 degrees or less, and having a diameter of equal to or greater than 3.40 mm).

4. The golf ball according to claim 2 wherein N1 to N9, which represent a number of kinds of the dimples, meet the following formula (IV), $$N1 \geqq N2 \geqq N3 > N4 \geqq N5 \geqq N6 \geqq N7 \geqq N8 \geqq N9 \quad \text{(IV)}$$

(In this formula (IV), N1 represents a number of kinds of the dimples being located in a first region whose latitude is 0 degree or greater and less than 10 degrees, and having a diameter of equal to or greater than 3.40 mm; N2 represents a number of kinds of the dimples being located in a second region whose latitude is 10 degrees or greater and less than 20 degrees, and having a diameter of equal to or greater than 3.40 mm; N3 represents a number of kinds of the dimples being located in a third region whose latitude is 20 degrees or greater and less than 30 degrees, and having a diameter of equal to or greater than 3.40 mm; N4 represents a number of kinds of the dimples being located in a fourth region whose latitude is 30 degrees or greater and less than 40 degrees, and having a diameter of equal to or greater than 3.40 mm; N5 represents a number of kinds of the dimples being located in the fifth region whose latitude is 40 degrees or greater and less than 50 degrees, and having a diameter of equal to or greater than 3.40 mm; N6 represents a number of kinds of the dimples being located in a sixth region whose latitude is 50 degrees or greater and less than 60 degrees, and having a diameter of equal to or greater than 3.40 mm; N7 represents a number of kinds of the dimples being located in a seventh region whose latitude is 60 degrees or greater and less than 70 degrees, and having a diameter of equal to or greater than 3.40 mm; N8 represents a number of kinds of the dimples being located in an eighth region whose latitude is 70 degrees or greater and less than 80 degrees, and having a diameter of equal to or greater than 3.40 mm; and N9 represents a number of kinds of the dimples being located in a ninth region whose latitude is 80 degrees or greater and 90 degrees or less, and having a diameter of equal to or greater than 3.40 mm).

* * * * *